US006547429B2

(12) United States Patent
Vanduyn et al.

(10) Patent No.: US 6,547,429 B2
(45) Date of Patent: Apr. 15, 2003

(54) BI-FUNCTIONAL TILTED AXIS REFLECTOR HEADLAMP

(75) Inventors: Paul D. Vanduyn, Anderson, IN (US); Tony E. Collins, Alexandria, IN (US)

(73) Assignee: Guide Corporation, Pendleton, IN (US)

( * ) Notice: Subject to any disclaimer, the term of this patent is extended or adjusted under 35 U.S.C. 154(b) by 0 days.

(21) Appl. No.: 09/943,247

(22) Filed: Aug. 30, 2001

(65) Prior Publication Data

US 2002/0067620 A1 Jun. 6, 2002

Related U.S. Application Data

(60) Provisional application No. 60/229,911, filed on Sep. 1, 2000.

(51) Int. Cl.[7] ..... F21V 21/02

(52) U.S. Cl. ..... 362/530; 362/37; 362/281; 362/427

(58) Field of Search ..... 362/37, 39, 40, 362/528, 529, 530, 271, 275, 277, 281, 283, 284, 419, 427, 428, 512, 514, 464, 465, 466

(56) References Cited

U.S. PATENT DOCUMENTS

| | | | | | |
|---|---|---|---|---|---|
| 4,959,758 | A | | 9/1990 | Filosa et al. | 362/66 |
| 4,974,123 | A | | 11/1990 | Luallin et al. | 362/66 |
| 5,111,369 | A | | 5/1992 | Shirai et al. | 362/61 |
| 5,150,958 | A | * | 9/1992 | Miyazawa et al. | 362/66 |
| 5,186,532 | A | * | 2/1993 | Ryder et al. | 362/66 |
| 5,251,114 | A | * | 10/1993 | Cantin et al. | 362/286 |
| 5,331,519 | A | * | 7/1994 | Fujino | 362/66 |
| 5,343,372 | A | * | 8/1994 | Shirai et al. | 362/66 |
| 5,446,632 | A | * | 8/1995 | Childs et al. | 362/69 |
| 5,526,238 | A | * | 6/1996 | Van Oel et al. | 362/66 |
| 5,567,034 | A | | 10/1996 | Dietewich et al. | 362/66 |
| 5,707,133 | A | * | 1/1998 | Burton | 362/66 |
| 5,762,415 | A | * | 6/1998 | Tolley | 362/66 |
| 5,769,525 | A | * | 6/1998 | Daumueller et al. | 362/66 |
| 5,833,346 | A | * | 11/1998 | Denley | 362/66 |

FOREIGN PATENT DOCUMENTS

| | | | | |
|---|---|---|---|---|
| EP | 0313779 | * | 5/1989 | B60Q/1/04 |
| JP | 2000085457 A | * | 3/1920 | B60Q/1/06 |

* cited by examiner

*Primary Examiner*—Sandra O'Shea
*Assistant Examiner*—John Anthony Ward
(74) *Attorney, Agent, or Firm*—Brian T. Ster; Alex D. Forman; Ice Miller

(57) ABSTRACT

A vehicle lamp assembly comprising a reflector, with three (3) mounting bosses arranged in a triangular fashion on the rear side thereof, a light source and a housing. Three (3) pivot sockets are fixedly attached to each mounting boss, respectively. The vehicle lamp assembly also comprises two (2) ball pivot adjusting screws that are movably secured within two (2) of the three (3) pivot sockets, and an actuator ball pivot that is movably secured within the third pivot socket. An actuator is fixedly attached at one end to the housing and attached at the other end to the actuator ball pivot in a manner that permits linear motion of the actuator. The invention further comprises a vertical adjuster plate and a reflector plate. Movement of the actuator causes the reflector to adjust in both the horizontal and vertical directions, thus allowing the vehicle lamp assembly to produce both low beam and high beam lighting functionality.

20 Claims, 4 Drawing Sheets

BI-FUNCTIONAL TILTED AXIS REFLECTOR HEADLAMP

CROSS REFERENCE TO RELATED APPLICATION

This application claims the benefit of U.S. Provisional Application No. 60/229,911, filed Sep. 1, 2000.

FIELD OF INVENTION

The present invention relates generally to automotive lamps. More specifically, the present invention relates to bi-functional automotive headlamps.

BACKGROUND

Generally, conventional automotive forward lighting systems, or headlamp systems, are required to provide lighting to meet two (2) distinct functions. First, a headlamp system must provide illumination adequate for a normal driving condition in which a vehicle and its driver are likely to encounter other vehicles on the roadway, paricularly such vehicles traveling in the opposite direction on the same roadway in the form of oncoming traffic. Under this condition, an automotive forward lighting system must provide illumination that is sufficient to safely illuminate the area in front of the vehicle, but not be aimed in such a direction that the illumination distracts, or even temporarily blinds, the drivers of oncoming traffic. The illumination produced by a headlamp system to meet this first function or requirement is commonly referred to as "low beam." Second, an automotive forward lighting system is required to provide additional illumination that can be utilized by a vehicle driver when additional lighting is necessary, but, for a variety of possible reasons, the concern over causing temporary discomfort to drivers of oncoming vehicles, is reduced or non-existent. The illumination typically provided under this function is generally directed slightly higher than that produced by a low beam, and generally more directly in front of the driver of the vehicle. The illumination produced by a headlamp system to meet this second function or requirement is commonly referred to as "high beam."

Because a headlamp system's ability to provide adequate illumination, under both the low beam and high beam functions, is so critical to the safety of the occupants not only of that vehicle, but also of other vehicles on the roadway, numerous government laws and regulations dictate the exact requirements that an automotive forward lighting system must meet for both its low beam and high beam functions. Thus, automotive headlamp systems must be designed to meet such strict requirements for both the low beam lighting function as well as the high beam lighting function.

Several automotive forward lighting system configurations are well known in the industry. For example, a commonly used configuration utilizes four (4) total headlamps, with two (2) positioned on each side of the front end of the vehicle. Generally, with this type of configuration, one (1) headlamp on each side of the vehicle is used to accomplish the low beam function. The high beam function may then be accomplished by, in some designs, utilizing the remaining two (2) headlamps on either side of the vehicle to provide additional illumination, or supplement the light produced by the first two (2) headlamps. In this type of configuration, all four (4) headlamps are illuminated to accomplish the high beam function. Alternatively, the four (4) headlamp system configuration may simply utilize two (2) headlamps, again one (1) on each side of the vehicle, for the low beam function and the remaining two (2) headlamps for the high beam function. In this type of configuration, only two (2) headlamps are illuminated at any given time, but four (4) headlamps are necessary to meet the dual functions and requirements of low beam and high beam.

Unfortunately, the four (4) lamp design generally described above contains several disadvantages. For example, such designs are expensive to produce as they require more headlamp units per vehicle. Additionally, these systems are generally more expensive because the parts associated with such systems (e.g., housings, retainers, brackets, screws) are either more complicated than would otherwise be necessary, or simply more of such parts are required for the multi-lamp configuration. Performance of such a system can also be an issue. Specifically, in a four (4) lamp system with only two (2) headlamps illuminated for the low beam function and only the other two (2) headlamps illuminated for the high beam function, when switching from one beam pattern to the other (either low beam to high beam or high beam to low beam) in such a system, the illumination pattern may change dramatically in an instant. Such a dramatic change is undesirable as it may briefly confuse or disorient the vehicle's driver. Also, when multiple lamps are used to accomplish the low beam and high beam lighting requirements, respectively, a color difference can occur between the low beam light and the high beam light. Such a color difference is not aesthetically pleasing or desirable.

Additionally, a four (4) lamp system may present safety concerns as it is possible during cold weather conditions for icing to occur on the outer surface of a headlamp if that headlamp is not illuminated continuously. Thus, a switch to high beam during such conditions may not provide the necessary illumination as the high beam headlamps have malfunctioned due to ice formation. Furthermore, the four (4) lamp system generally requires more space which can be problematic on the front end of a vehicle where the space available for any one assembly is at a minimum. Thus, these four (4) lamp systems, which can be relatively large, tend to limit design options for a vehicle's front-end. Moreover, the overall appearance of the four (4) lamp system, which again is generally larger and contains more parts, is considered by some as undesirable, especially for vehicles in which a sleek, aerodynamic appearance is important. Finally, because multiple lamp systems utilize more lamps, usually four (4) compared to two (2), they generally require and consume more electrical energy.

In order to attempt to address the shortcomings of the four (4) headlamp system, two (2) headlamp systems have been developed and are well known in the art. These two (2) headlamp systems utilize only a single lamp on each side of the front end of a vehicle, with each of those lamps performing both the low beam and high beam lighting functions. For ease of reference, the term "bi-functional" is used herein to describe such a single automotive headlamp unit that is capable of producing both a low beam lighting pattern and a high beam lighting pattern. One example of a bi-functional system used in the past is a system that utilizes two (2) headlamps, each with two (2) light bulb filaments. The different filaments of each lamp are utilized independently to accomplish the low beam function and the high beam function, respectively. Thus, while having the appearance of only utilizing two (2) lamps, in essence, this type of forward lighting system still utilizes four (4) light sources. This type of system also has disadvantages. The specialized bulbs utilized for this type of system can be overly complex and expensive to both manufacture and replace.

Additionally, replacement may be necessary if "burn-out" occurs for the bulb filament accomplishing one (1) lighting function, even though the filament for the other function is still in working condition.

Another attempt to accomplish bi-functionality for a two (2) lamp forward automotive lighting system that is known in the industry involves lamps that allow the light source to be repositioned relative to the lamp reflector. Generally, in order to accomplish high beam functionality the light source, or light bulb, is repositioned relative to the headlamp reflector thus changing the direction of the emitted light. While bi-functionality is accomplished by this system, it is necessary to closely control the critical tolerances involved with repositioning the light source. Such control can be difficult and expensive to accomplish initially, and may be even more difficult to control over the life of the vehicle. Subtle changes in the positioning of the light source can result in undesirable shifts in the vehicle lighting pattern for either the low beam or high beam, or even both. Thus, the reliability of such a system is suspect. Furthermore, adjusting the "aim" of such an assembly, which is necessary both prior to a vehicle being put into use by a consumer and, under some circumstances, during the life of the vehicle, can be difficult.

Therefore, it is desired to provide a bi-functional automotive forward lighting system which utilizes only two (2) headlamps that each accomplish both the low beam and high beam lighting functions. It is further desired that such a bi-functional headlamp system provide an assembly which reliably meets the forward lighting requirements of a vehicle, while not being overly complex or expensive to manufacture. It is additionally desired that such a system provide a means for adjusting headlamp aim that is not overly complicated or cumbersome to use.

SUMMARY

The present invention provides a bi-functional automotive forward lighting system, that utilizes only two (2) headlamps, wherein bi-functionality is accomplished by pivoting the headlamp reflector about three (3) pivot points arranged in a triangular manner. The invention comprises a headlamp reflector which includes three (3) mounting bosses, arranged in a triangular fashion, on the rear surface of the reflector. A pivot socket is fixedly attached to each mounting boss. Additionally, a ball pivot adjusting screw is movably secured within two (2) of the three (3) pivot sockets, while an actuator ball pivot is movably secured within the third pivot socket. An actuator is attached to the actuator ball pivot in a manner that permits linear motion of the actuator, which is also fixedly attached to a lamp housing. The invention further comprises a vertical adjuster plate and a reflector plate.

Initial horizontal and vertical aim of the invention for the low beam function may be accomplished by adjustment of one (1) of the ball pivot adjusting screws for each direction of aim.

Once the initial adjustments are completed, the headlamp is set for low beam operation. In order to achieve bi-functionality and accomplish the high beam function, the headlamp reflector is simply moved by adjustment of the actuator attached to the actuator ball pivot. Due to the triangular arrangement of the pivot points, movement of the actuator will cause the headlamp reflector to adjust in both the horizontal and vertical directions. This slight adjustment of the headlamp reflector for each of the two (2) lamps of the invention allows the headlamp assembly of the invention to accomplish the high beam function.

DESCRIPTION

Figure 1:
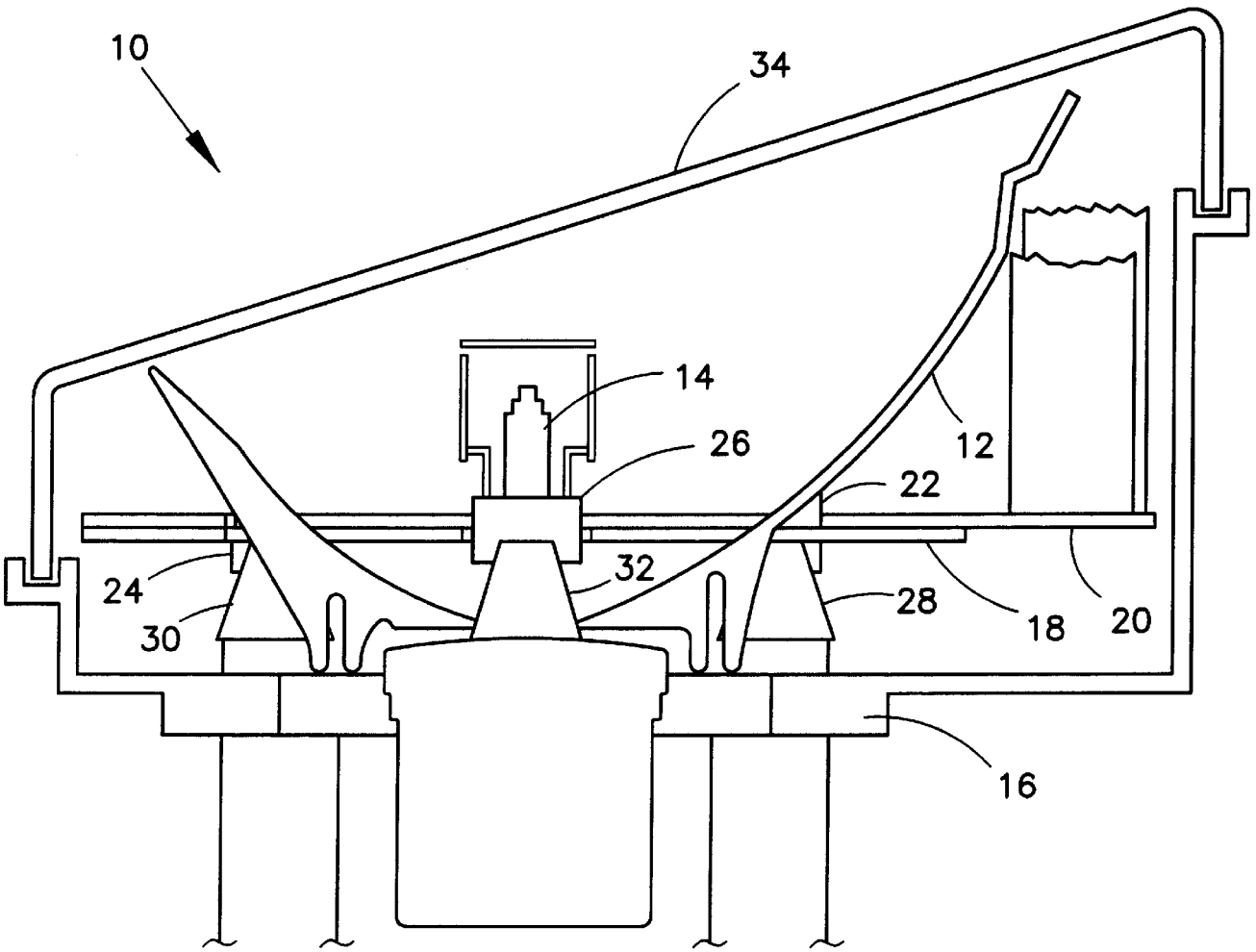
FIG. 1 is a top view of a bi-functional headlamp assembly.

Referring to FIG. 1, there is shown a top view of a bi-functional headlamp assembly 10 of the present invention. Bi-functional headlamp assembly 10 comprises a headlamp reflector 12, a light source 14 and a lamp housing 16. Lamp housing 16 is fixedly attached to a motor vehicle (not shown in the Figures). It should be noted that only a small portion of lamp housing 16 is shown in FIG. 1 for ease of reference to bi-functional headlamp assembly 10. Bi-functional headlamp assembly 10 further comprises a vertical adjuster plate 18 and a lamp attachment plate 20. Reflector plate 20 is attached to reflector 12 in any one (1) of a variety of manners commonly known to those of ordinary skill in the art. Vertical adjuster plate 18 is attached to reflector plate 20 in any one (1) of a variety of manners commonly known to those of ordinary skill in the art. Light source 14 is fixedly attached to reflector 12, in any one (1) of a variety of manners commonly known to those of ordinary skill in the art, such that light source 14 is retained at its "in focus" position relative to reflector 12. More specifically, reflector 12 is of such a shape that causes it to possess a focus, and light source 14 is positioned at that focus.

Referring further to FIG. 1, the rear side of headlamp reflector 12 contains three (3) mounting bosses 22, 24 and 26, respectively. Bi-functional headlamp assembly 10 further comprises three (3) pivot sockets, 28, 30 and 32, respectively. Each of pivot sockets 28, 30 and 32 are fixedly attached to mounting bosses 22, 24 and 26, respectively. FIG. 1 also shows headlamp lens 34 of bi-functional headlamp assembly 10.

Figure 2:
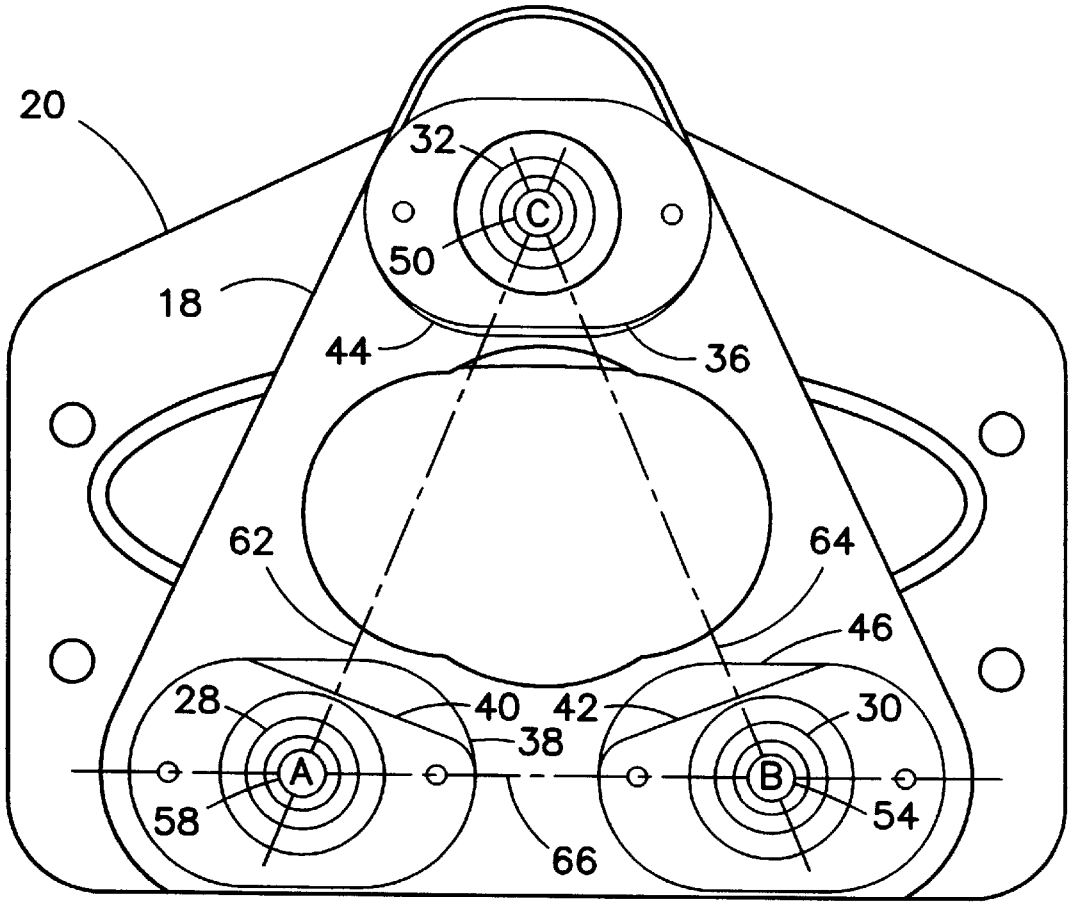
FIG. 2 is a front elevation view of the vertical adjuster plate and the reflector plate of the headlamp assembly of FIG. 1.

Referring now to FIG. 2, there is shown a front elevation view of vertical adjuster plate 18 and reflector plate 20. Headlamp reflector 12 is not shown in FIG. 2 for ease of reference. As shown in FIG. 2, bi-functional headlamp assembly 10 further comprises upper pivot slip plate 36, solenoid slip plate 38, first lower pivot slip plate 40 and second lower pivot slip plate 42. Also shown in FIG. 2 is first adjuster slip plate 44 and second adjuster slip plate 46. Each of the aforementioned slip plates 36 through 46, respectively, are attached, either directly or indirectly, to vertical adjuster plate 18 and reflector plate 20, in any one (1) of a variety of manners well known to those of ordinary skill in the art.

Figure 3:
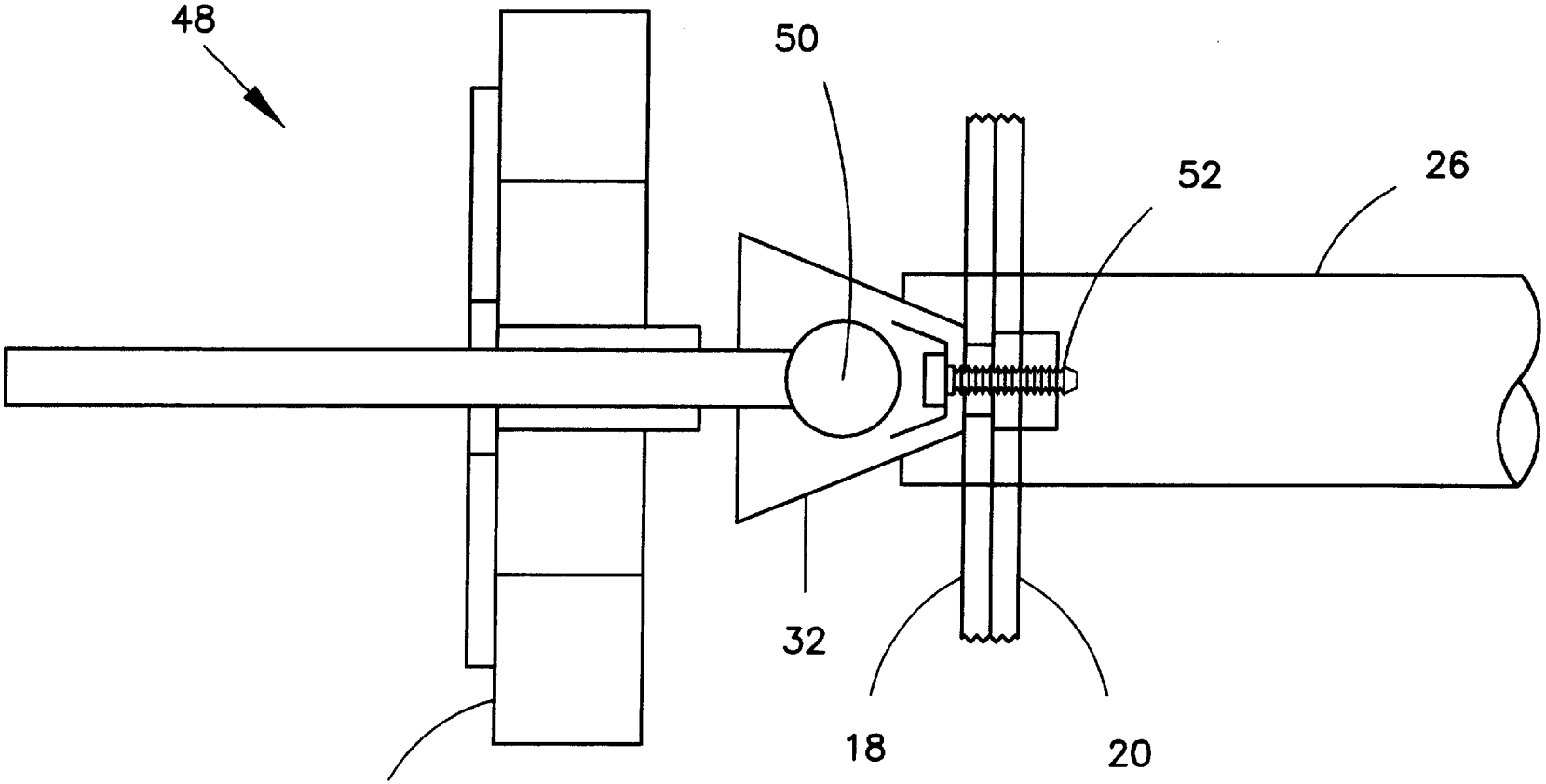
FIG. 3 is a side view of a pivot socket and ball pivot adjusting screw sub-assembly of the headlamp assembly of FIG. 1.

Referring to FIG. 3, there is shown a side view of a pivot socket and ball pivot adjusting screw sub-assembly 48 of bi-functional headlamp assembly 10. Pivot socket and ball pivot adjusting screw sub-assembly 48 comprises ball pivot adjusting screw 50, which is movably mounted within pivot socket 32. As shown in FIG. 3, pivot socket 32 is fixedly attached to mounting boss 26 by mounting screw 52. It will be understood by those of ordinary skill in the art that other mounting means could be utilized to attach pivot socket 32 to mounting boss 26. While FIG. 3 shows pivot socket and ball pivot adjusting screw sub-assembly 48, which corresponds to pivot socket 32, bi-functional headlamp assembly 10 further comprises an identical pivot socket and ball pivot adjusting screw sub-assembly corresponding to pivot socket 30. Referring back to FIG. 2, the second pivot socket and ball pivot adjusting screw sub-assembly is represented by adjusting screw 54. Though not shown in the figures, adjusting screws 50 and 54, respectively, are attached directly or indirectly to housing 16 by a means that permits longitudinal adjustment of adjusting screws 50 and 54, respectively.

Figure 4:
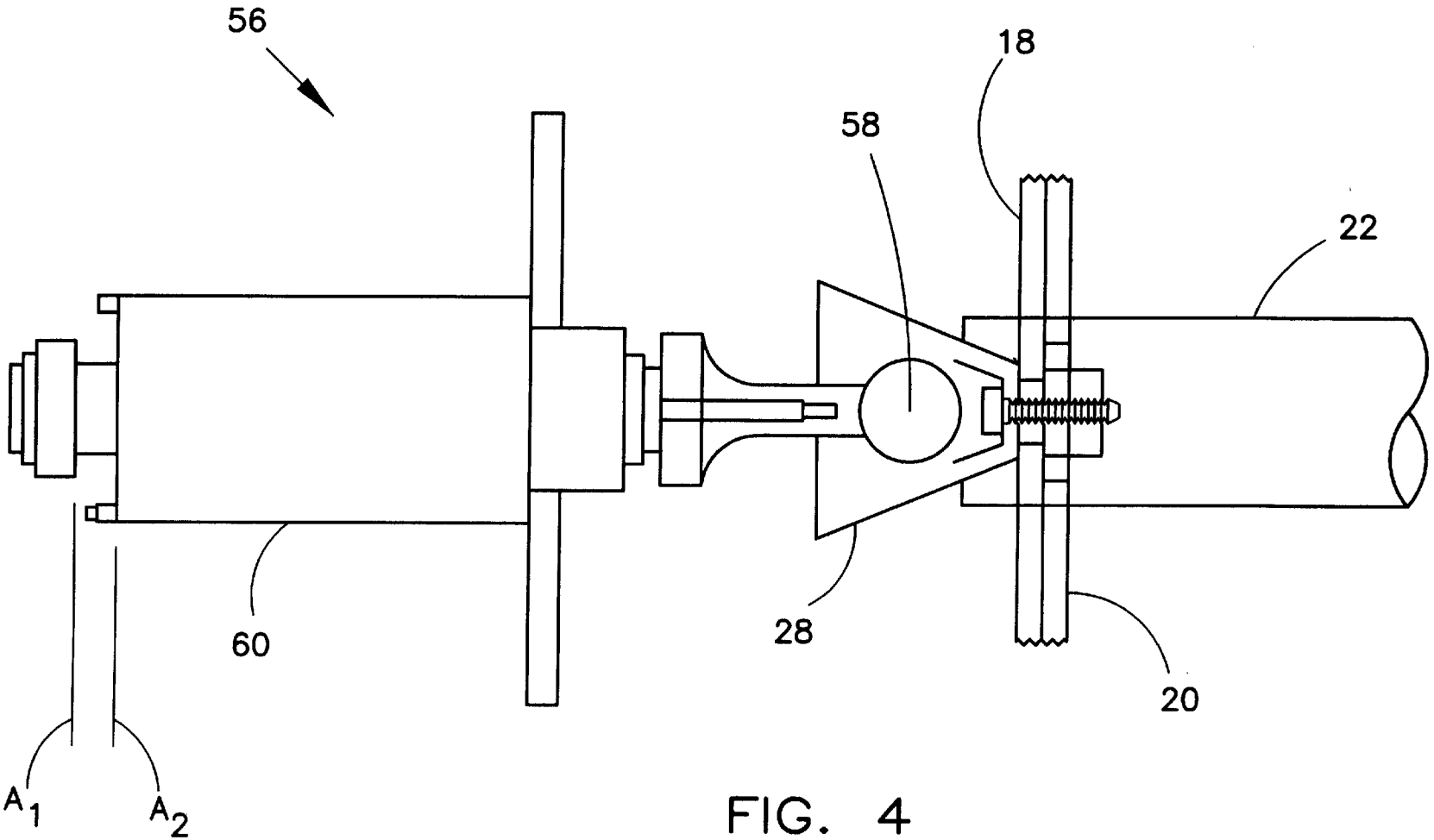
FIG. 4 is a side view of a pivot socket and actuator ball pivot sub-assembly of the headlamp assembly of FIG. 1.

Referring now to FIG. 4, there is shown a side view of a pivot socket and actuator ball pivot sub-assembly 56 of bi-functional headlamp assembly 10. As shown in FIG. 4, pivot socket and actuator ball pivot sub-assembly 56 corresponds to pivot socket 28 and mounting boss 22. Pivot socket and actuator ball pivot sub-assembly 56 comprises an actuator ball pivot 58 which is fixedly attached to an actuator 60. Actuator 60 is fixedly attached to housing 16 (not shown in FIG. 4).

Referring again to FIG. 2, as shown therein, there exist three (3) pivot points for bi-functional headlamp assembly 10. These pivot points are arranged in a triangular formation and are represented in the figure by adjusting screw 50, adjusting screw 54 and actuator ball pivot 58. As further shown in FIG. 2, the arrangement of these pivot points forms three (3) axes, denoted as dashed lines 62, 64 and 66, respectively.

Actuator ball pivot 58 serves as an origin point about which bi-functional headlamp assembly 10 is rotated to achieve bi-functionality. However, initial adjustment and aim for the low beam function of bi-functional headlamp assembly 10 in the vertical and horizontal directions is accomplished by adjustment of adjusting screw 50 and adjusting screw 54, respectively. Specifically, initial aim of bi-functional headlamp assembly 10 in the vertical direction is accomplished by adjustment of adjusting screw 50, which results in rotation of headlamp reflector 12 about axis 66. Similarly, initial aim of bi-functional headlamp assembly 10 in the horizontal direction (with a slight vertical component) is accomplished by adjustment of adjusting screw 54, which results in rotation of headlamp reflector 12 about axis 62. Adjustments to adjusting screw 50 and adjusting screw 54 are made until the proper illumination is achieved by bi-functional headlamp assembly 10 for the low beam function.

In operation, in order to switch bi-functional headlamp assembly 10 from low beam functionality to high beam functionality, actuator 60 is simply activated and moved linearly a calculated distance. While not shown in the Figures, it will be appreciated that activation of actuator 60 may be accomplished in any one (1) of a variety of manners well known to those of ordinary skill in the art, including, for example by electromechanical means with a switching mechanism within easy reach of a vehicle's operator. Movement of actuator 60 results in movement of actuator ball pivot 58, which in turn results in movement, or a shift, of reflector 12. This shift of reflector 12 repositions the optical axis of bi-functional headlamp assembly 10 slightly to the left and upward, in a manner determined by the relative positioning, or tilt, of axis 64. Because the distance traveled by actuator 60 will actually form a slight arc, again determined by the tilt of axis 64, the attitude of actuator 60 must be such to decrease below some critical point the amount of side loading experienced by actuator 60. In essence, actuator 60 can be moved any precise distance required, based upon the individual requirements of a vehicle upon which bi-functional headlamp assembly 10 is incorporated, to allow bi-functional headlamp assembly 10 to accomplish the high beam function.

While the present invention has been described in considerable detail with reference to a certain exemplary embodiment thereof, such is offered by way of non-limiting example of the invention as many other versions are possible. For example, by simply moving the placement of pivot socket and actuator ball pivot sub-assembly 56 to the other lower corner of the three (3) pivot points, a switch to high beam functionality would result in a shift of directed illumination upward and to the right. Such an embodiment would accommodate vehicles driven in locations where vehicles are operated on the left side of the roadway. It is anticipated that a variety of other modifications and changes will be apparent to those having ordinary skill in the art and that such modifications and changes are intended to be encompassed within the spirit and scope of the invention as defined by the appended claims.

What is claimed is:

1. A vehicle lamp assembly comprising:

a housing;

a reflector, having a front side and a rear side;

a light source fixedly attached to the reflector;

a first mounting boss positioned on the rear side of the reflector, having a first pivot socket fixedly attached thereto;

a first ball pivot adjusting screw, having a front end and a rear end, with the front end of the first ball pivot adjusting screw movably mounted within the first pivot socket and the rear end of the first ball pivot adjusting screw attached to the housing;

a second mounting boss positioned on the rear side of the reflector, having a second pivot socket fixedly attached thereto;

a second ball pivot adjusting screw, having a front end and a rear end, with the front end of the second ball pivot adjusting screw movably mounted within the second pivot socket and the rear end of the second ball pivot adjusting screw attached to the housing;

a third mounting boss positioned on the rear side of the reflector, having a third pivot socket fixedly attached thereto;

an actuator ball pivot, having a front end and a rear end, with the front end of the actuator ball pivot movably mounted within the third pivot socket; and an actuator, having a front end and a rear end, with the front end of the actuator attached to the rear end of the actuator ball pivot and the rear end of the actuator fixedly attached to the housing.

2. The vehicle lamp assembly of claim 1 further comprising a reflector plate, attached to the reflector, and a vertical adjuster plate, attached to the reflector plate.

3. The vehicle lamp assembly of claim 2 further comprising a plurality of slip plates attached to the vertical adjuster plate and the reflector plate.

4. The vehicle lamp assembly of claim 1 wherein initial aiming of the vehicle lamp assembly is accomplished by adjustment of the first ball pivot adjusting screw and the second ball pivot adjusting screw.

5. The vehicle lamp assembly of claim 1 wherein the actuator is movable to a first position and a second position, with the actuator first position causing the vehicle lamp assembly to produce a low beam lighting pattern and the actuator second position causing the vehicle lamp assembly to produce a high beam lighting pattern.

6. The vehicle lamp assembly of claim 5 wherein the actuator is movable linearly between the actuator first position and the actuator second position which causes the reflector to rotate about an axis formed by the front end of the first ball pivot adjusting screw and the front end of the second ball pivot adjusting screw.

7. The vehicle lamp assembly of claim 1 wherein the first, second and third mounting bosses are arranged on the rear side of the reflector in a triangular formation.

8. The vehicle lamp assembly of claim 1 wherein the reflector has a focus and the light source is fixedly positioned at the focus.

9. The vehicle lamp assembly of claim 1 wherein the first pivot socket is attached to the first mounting boss with a screw.

10. A vehicle lamp assembly comprising:

a housing;

a reflector, having a front side and a rear side;

a light source fixedly attached to the reflector;

a plurality of mounting bosses positioned on the rear side of the reflector;

a plurality of pivot sockets fixedly attached to the plurality of mounting bosses;

a vertical adjustment means for vertically adjusting the reflector about a first axis, the vertical adjustment means moveably attached at one end to one of the pivot sockets and fixedly attached at the other end to the housing;

a horizontal adjustment means for horizontally adjusting the reflector about a second axis, the horizontal adjustment means moveably attached at one end to one of the pivot sockets and fixedly attached at the other end to the housing; and a movement means for moving the reflector about a third axis, the movement means moveably attached at one end to one of the pivot sockets and fixedly attached at the other end to the housing.

11. The vehicle lamp assembly of claim 10 further comprising a reflector plate, attached to the reflector, and a vertical adjuster plate, attached to the reflector plate.

12. The vehicle lamp assembly of claim 11 further comprising a plurality of slip plates attached to the vertical adjuster plate and the reflector plate.

13. The vehicle lamp assembly of claim 10 wherein initial aiming of the vehicle lamp assembly is accomplished by adjustment of the vertical adjustment means and the horizontal adjustment means.

14. The vehicle lamp assembly of claim 10 wherein the movement means is movable to a first position and a second position, with the movement means first position causing the vehicle lamp assembly to produce a low beam lighting pattern and the movement means second position causing the vehicle lamp assembly to produce a high beam lighting pattern.

15. The vehicle lamp assembly of claim 14 wherein the movement means is movable linearly between the movement means first position and the movement means second position which causes the reflector to rotate about an axis formed by the pivot socket attached to the vertical adjustment means and the pivot socket attached to the horizontal adjustment means.

16. The vehicle lamp assembly of claim 10 wherein the vehicle lamp assembly comprises at least three mounting bosses and the mounting bosses are arranged on the rear side of the reflector in a triangular formation.

17. The vehicle lamp assembly of claim 10 wherein the reflector has a focus and the light source is fixedly positioned at the focus.

18. The vehicle lamp assembly of claim 10 wherein a pivot socket is attached to a mounting boss with a screw.

19. The vehicle lamp assembly of claim 10 wherein the movement means is an actuator.

20. An automotive headlamp assembly adapted to be mounted on the front end of a motor vehicle, the automotive headlamp assembly comprising:

a housing fixedly attached to the front end of the motor vehicle;

a reflector, having a front side and a rear side;

a light source fixedly attached to the reflector;

a first mounting boss positioned on the rear side of the reflector, having a first pivot socket fixedly attached thereto;

a first ball pivot adjusting screw, having a front end and a rear end, with the front end of the first ball pivot adjusting screw movably mounted within the first pivot socket and the rear end of the first ball pivot adjusting screw attached to the housing;

a second mounting boss positioned on the rear side of the reflector, having a second pivot socket fixedly attached thereto;

a second ball pivot adjusting screw, having a front end and a rear end, with the front end of the second ball pivot adjusting screw movably mounted within the second pivot socket and the rear end of the second ball pivot adjusting screw attached to the housing;

a third mounting boss positioned on the rear side of the reflector, having a third pivot socket fixedly attached thereto;

a ball pivot, having a front end and a rear end, with the front end of the ball pivot movably mounted within the third pivot socket; and a movement means for moving the reflector, the movement means movably attached at one end to the rear end of the ball pivot and fixedly attached at the other end to the housing.

* * * * *